US005894706A

United States Patent [19]

Herbst

[11] Patent Number: 5,894,706

[45] Date of Patent: Apr. 20, 1999

[54] MOLDED WINDOW DOOR AND METHOD

[76] Inventor: Walter B. Herbst, 1875 N. Pond La., Lake Forest, Ill. 60045

[21] Appl. No.: 08/700,553

[22] Filed: Aug. 13, 1996

[51] Int. Cl.[6] ..... E04C 2/00; E04C 2/54

[52] U.S. Cl. ..... 52/782.1; 52/204.71; 52/204.705; 52/782.24; 52/784.1; 52/796.1; 52/800.1; 52/455; 49/501; 49/502; 49/503; 160/371; 160/369; 160/380

[58] Field of Search ..... 52/204.71, 782.5, 52/782.24, 784.1, 796.1, 800.1, 204.2, 204.705, 204.61, 784.12, 784.13, 455, 204.1; 49/503, 501, 502; 160/371, 369, 380

[56] References Cited

U.S. PATENT DOCUMENTS

| | | | |
|---|---|---|---|
| 5,133,168 | 7/1992 | Neilly et al. | 52/204.5 |
| 5,363,611 | 11/1994 | Richardson et al. | 52/784.1 X |
| 5,410,846 | 5/1995 | Frambach | 52/204.5 |
| 5,546,714 | 8/1996 | Kenkel | 52/204.71 X |
| 5,634,508 | 6/1997 | Herbst | 52/784.1 X |

*Primary Examiner*—Carl D. Friedman
*Assistant Examiner*—W. Glenn Edwards
*Attorney, Agent, or Firm*—Jack E. Dominik

[57] ABSTRACT

A recites full view door in which the frame portion is totally molded. It may be molded in a number of processes from polypropylene or other materials, with or without additives, and other plastics suitable for large molded frames. There is an outside section of the frame and an inside section which are modified for securement each to the other. Provision is made in the interior edges of the frame for receiving the pane of glass, and then a holding assembly is provided, primarily four pieces being top, bottom and the two sides which snap-fits into the inside portion of the frame and secures the window in removable engagement to the door. In the method, means are provided on the outer half and the inner half for snap-fittingly or press-fittingly engaging each other. In addition, sonic welding, gluing, and other means for securing the outer half and the inner half of the door are contemplated.

13 Claims, 4 Drawing Sheets

MOLDED WINDOW DOOR AND METHOD

FIELD OF THE INVENTION

The present invention relates primarily to storm doors but can relate to primary doors for dwellings. More particularly, the invention relates to a full view door in which the major portion of its frontal area is a transparent window. The method also relates to the forming of the subject full view door.

BACKGROUND OF THE INVENTION

The art with regard to doors for residences is very broad. Some doors are storm doors, some doors are full solid doors, some doors have partial lights at the upper portion, and some doors are full view. The present invention is directed to such a full view door where the sides, top and bottom of the door are sufficient to supply the strength for securing the door and opening and closing, but sufficiently narrow to permit the insertion of a glass window so that there is a large viewing area. This is why such doors are called full view.

Most full view storm doors are assembled from an aluminum or plastic extrusion frame. This requires the cutting of four members: two sides, a top, and a bottom. Moreover, those members need to be primarily mitered at the four joints for securing together and presenting a neat aesthetic exterior appearance. A difficulty arising, of course, is the cost of mitering. In addition an L-shaped bracket or other securement means is normally required at each of the four joints. Thereafter, normally the extrusions will receive the glass and/or screen and the door is secured. All full view doors provide for clips which will secure the window in place, but these are relatively unsightly, complicated, and the clips themselves can become lost.

SUMMARY OF THE INVENTION

The present invention is directed to a full view door in which the frame portion is totally molded. It may be molded in a number of processes from polypropylene or other materials, with or without additives, and other plastics suitable for large molded frames. There may be an outside section of the frame and an inside section which are modified for securement each to the other or the frame may be molded in one piece. Provision is made in the interior edges of the frame for receiving the pane of glass, and then a holding assembly is provided, primarily four pieces being top, bottom and the two sides which snap-fits into the inside portion of the frame and secures the window in removable engagement to the door. In the method, where there is an outside and an inside frame, means are provided on the outer half and the inner half for snap- fittingly or press-fittingly engaging each other. In addition, sonic welding, gluing, and other means for securing the outer half and the inner half of the door are contemplated.

In view of the foregoing it is a principal object of the present invention to provide a full view glass door which is molded of a single piece of plastic for the outside and a single piece of plastic for the inside thereby eliminating the necessity for providing miter joints at the four corners. Based on the process used, the door can also be molded in one piece. Processes for the one piece frame include, but are not limited to blow molding, roto molding, and gas assist injection molding.

A further object of the present invention is to provide a molded door which readily engages and mounts the full view window from the interior portion.

Yet another object of the present invention is to provide a molded door which will accept a window, and yet be interchangeable for a screen simply substituted for the window portion.

In addition, a further object of the present invention is to provide a molded full view door which assembles easily and in certain embodiments is secured by press-fittingly engaging one of the molded halves to the other.

BRIEF DESCRIPTION OF THE DRAWINGS

Further objects and advantages of the present invention will become apparent, as the following description of an illustrative embodiment proceeds, taken in conjunction with the accompanying drawings, in which:

In FIG. 9 the outer half is exploded away from the inner half as contrasted with FIG. 8 where the two halves are shown in their assembled configuration.

DESCRIPTION OF A PREFERRED EMBODIMENT

Figure 1:
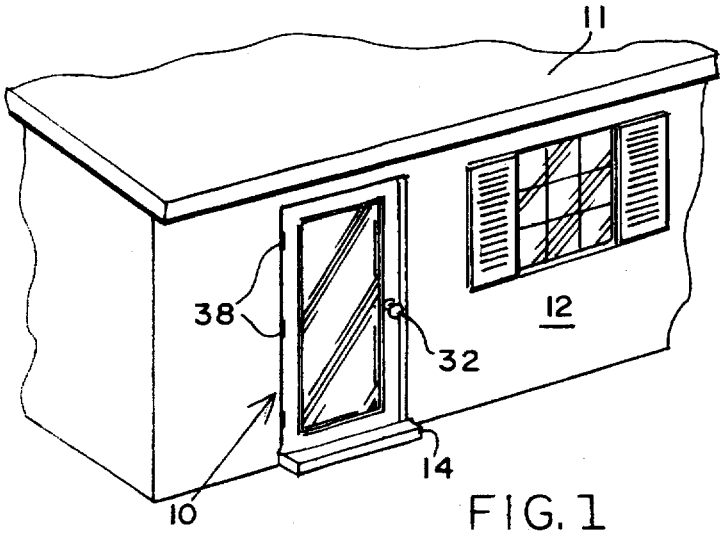
FIG. 1 is a perspective corner view of a typical residence showing a full view door illustrative of the present invention.
Figure 2:
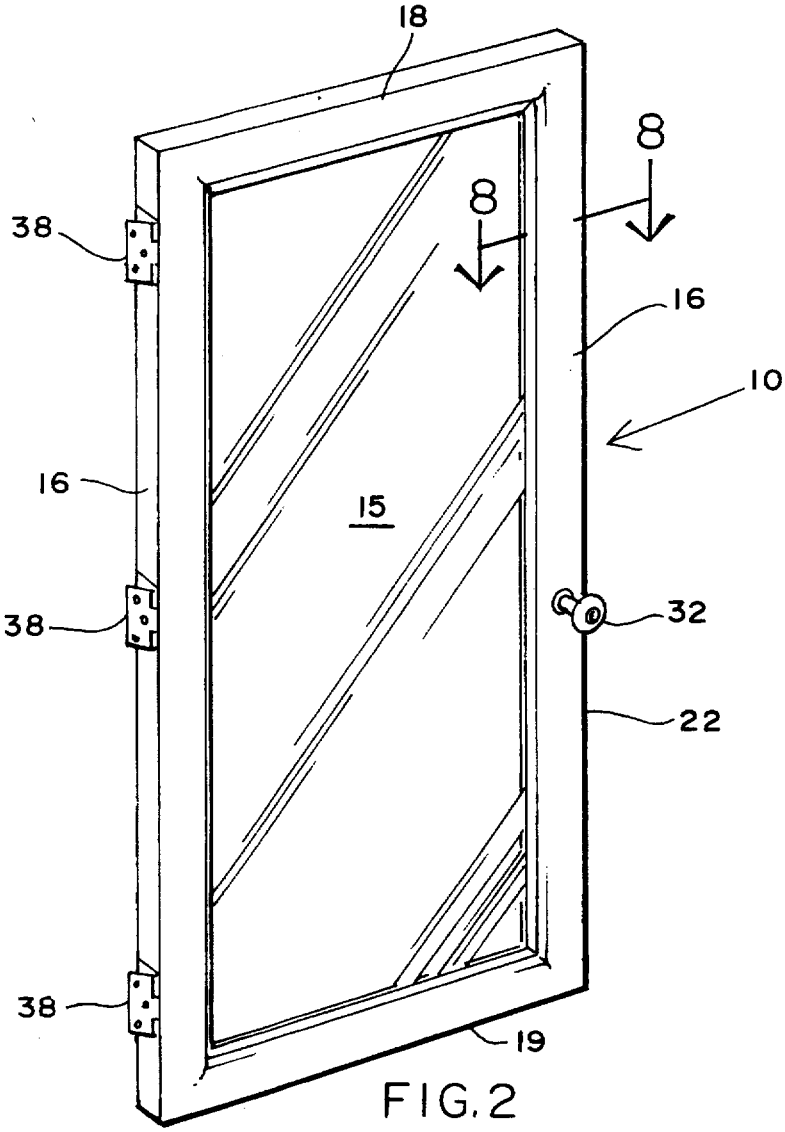
FIG. 2 is an enlarged perspective view of the door shown in FIG. 1.

The subject full view door 10 is shown as applied to a house 11 on the front wall 12 of the house 11 with a threshold 14 at the lower portion of the door. More specifically the door 10 as shown in FIG. 2 has a glass panel 15 secured at its central portion. The glass panel 15 is proportioned to fit between the sides 16 of the door 10 and be secured by the top 18 and the bottom 19 in place.

Figure 3:
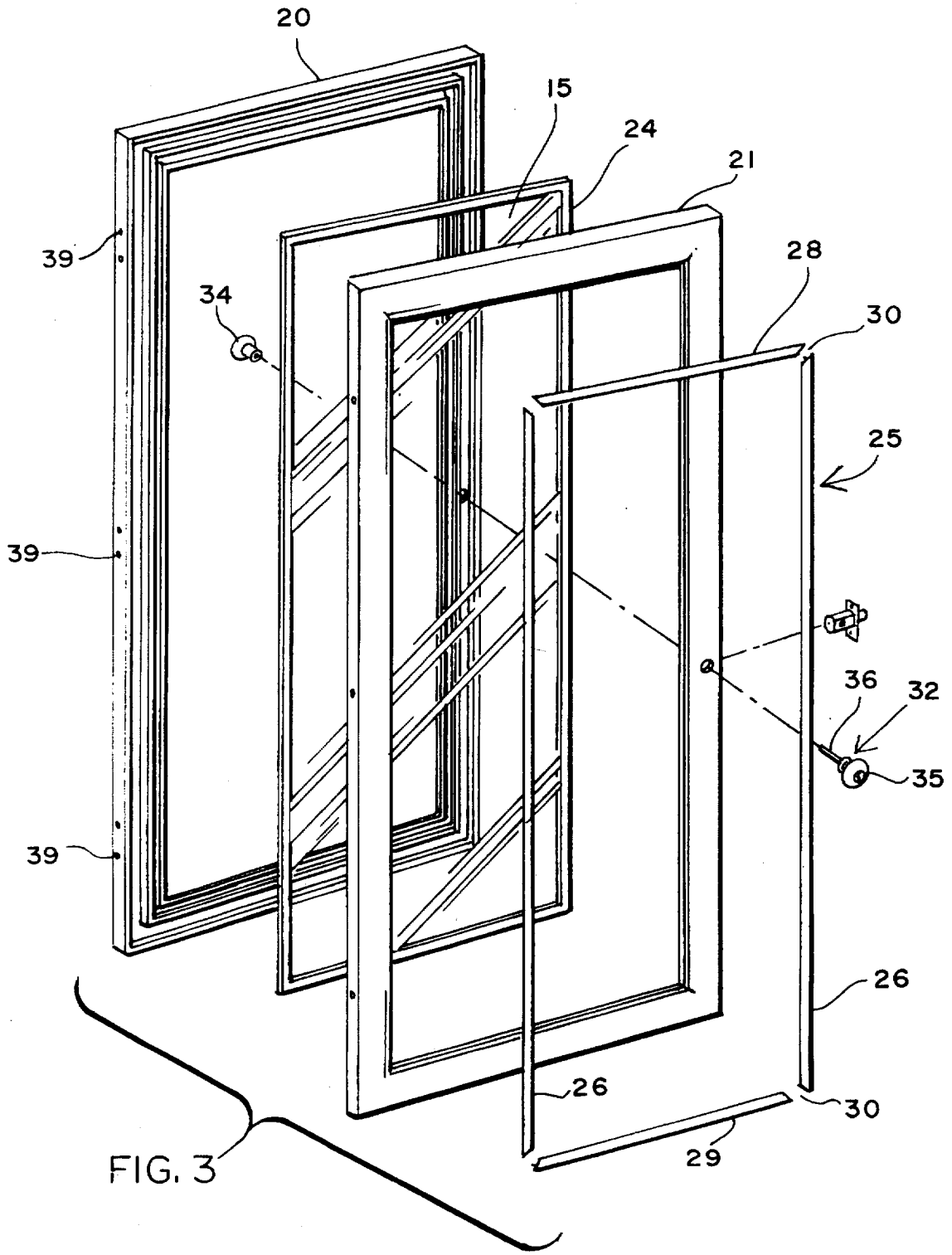
FIG. 3 is yet a further enlarged perspective exploded view of the door shown in FIGS. 1 and 2 illustrating the relationship between the two frame halves, the window, and the mounting strip for securing the window in place and also illustrating the application of a door handle.
Figures 4, 5, 6, 7:
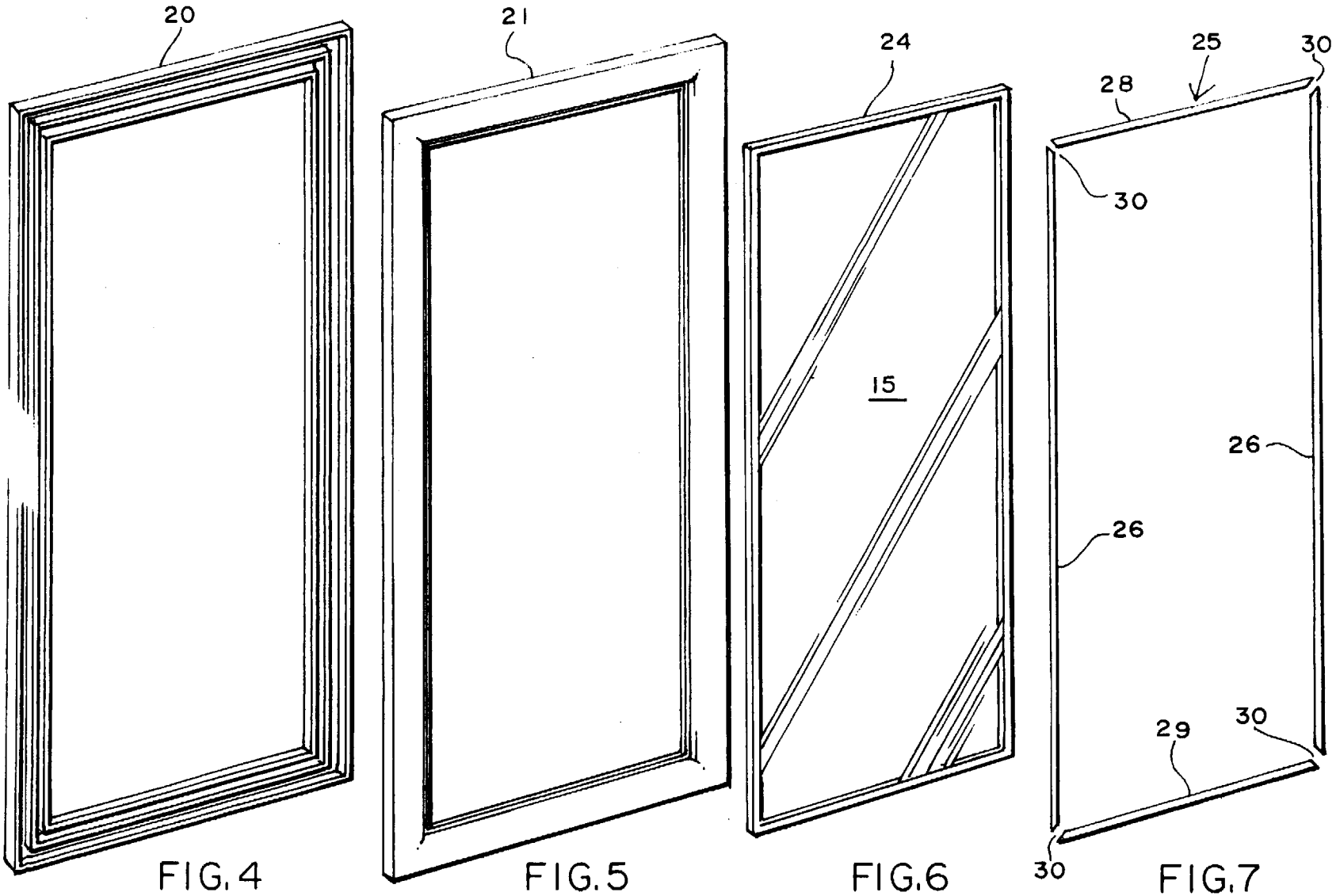
FIG. 4 is yet another view in which the elements of FIG. 3 are separated from each other with FIG. 4 showing the outer frame portion of the door.
FIG. 5 shows the inner frame portion of the door looking at the inside of the inner frame.
FIG. 6 is a perspective view of the window portion showing its edge trim.
FIG. 7 is a perspective view of the four snap-fitting members which secure the window in place on the interior portion of the door.

Turning now to FIG. 3, it will be seen that there are shown an outer frame member 20 and an inner frame member 21 which comprise together the door frame 22. More particularly as shown in FIG. 3, between the outer frame 20 and the inner frame 21 is the glass 15 which has a surrounding trim and gasket 24 to assist in removably securing the window glass 15 to the door frame 22. Finally, it will be seen in FIG. 3 where the holding strip assembly 25 is made up of two side pieces 26 and a top 28 and a bottom 29. The holding strip assembly has miter joints 30 at its four corners as will be shown and described in great detail in connections with FIGS. 8–10. Provision is made for door knob assembly 32 which includes outer door knob 34 and the inner door knob 35. The relief holes necessary to secure the door knob assembly 32 in place may optionally be formed as a forming step after the outer frame 20 and the inner frame 21 are molded or alternatively molded in both frames with a pre-selected area where drilling can be done in order to pass the shaft 36 between the outer knob 34 and the inner knob 36. Hinges 38 secure the door in place. They mount the door through hinge mount holes 39. Turning now to FIGS. 4–7, there it will be seen in greater detail that the outer frame 20 is devised to engage the inner frame 21. The window glass 15 is provided with window glass trim 24 to inhibit cutting of the fingers and gasketing the glass as well as protect the exterior edges of the glass 15 from being nicked. The trim assembly 24 is shown in FIG. 7.

Figure 8A:
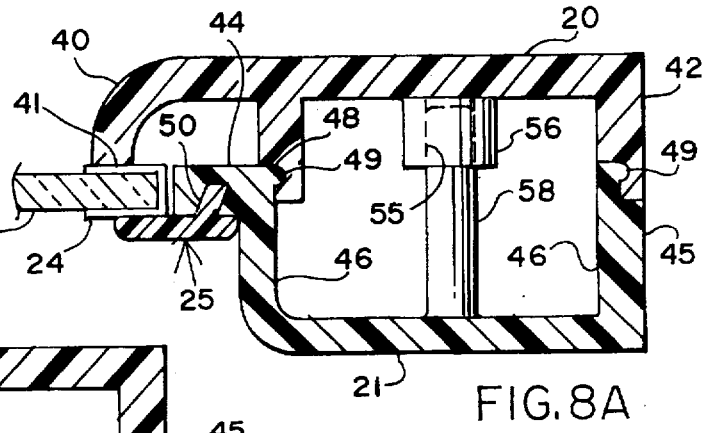
FIG. 8A is a transverse sectional view of a lateral edge of the door as shown in FIG. 2 taken along section line 8—8 of FIG. 2.
Figure 8B:
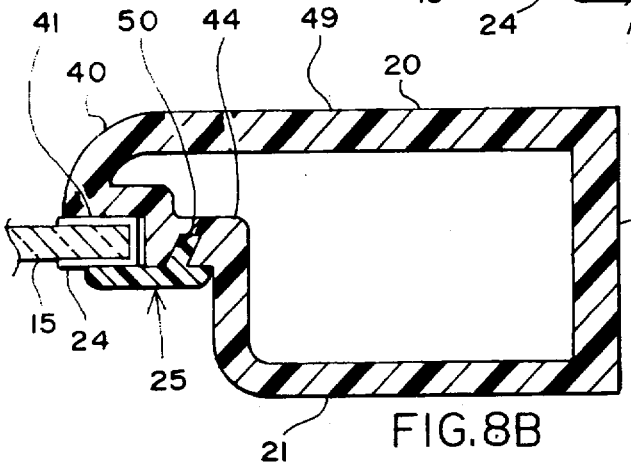
FIG. 8B is a transverse sectional view of a lateral edge of the door which has been molded in one piece shown in the same scale from essentially the same lateral edge of the door as in FIG. 2, Section Line 8—8.

Turning now to FIG. 8 it will be seen further that the outer frame 20 engages the inner frame 21 and has an overlapping curvilinear end portion 40 which is proportioned to overlie the trim 24 of the glass 15 with a window clamp portion 41. Similarly an engaging rib 41 extends inwardly from the outer frame 20 and is substantially parallel to the second engaging rib 42 which rib 42 also serves as part of the lateral edge 45 of the door 10. As to the inner half 21, again as shown in FIG. 8, it will be seen that it has an inner end wall 46 which curves toward the opposing rib 41 and is in proportion to abuttingly and partially interlockingly receive the rib 41. Rib 41 terminates in a perpendicularly extending holding assembly platform 44 which also abuttingly engages the frame 24 of the glass 15. In one embodiment, the rib 41 is provided with a recess 48 which in turn snap-fittingly engages a tang 49 to help secure the two halves together. A similar recess 48 is provided on the end rib 42 and coacts with a similar tang 49 on the lateral edge 45 of the inner frame 21. These may be further secured by glue, sonic welding, and other techniques for securing the two halves together.

Once the window 15 is positioned in place as shown in FIG. 8, the trim 24 is inserted to hold the window 15 and its associated trim 24 in place. The trim 24 includes a locking prong 50 which goes into a locking prong socket 51. An alternative construction contemplates that the locking prong 50 will be perpendicular with the exterior portion of the trim 24 and the end enlarged to press-fittingly engage the socket 51.

Figure 9:
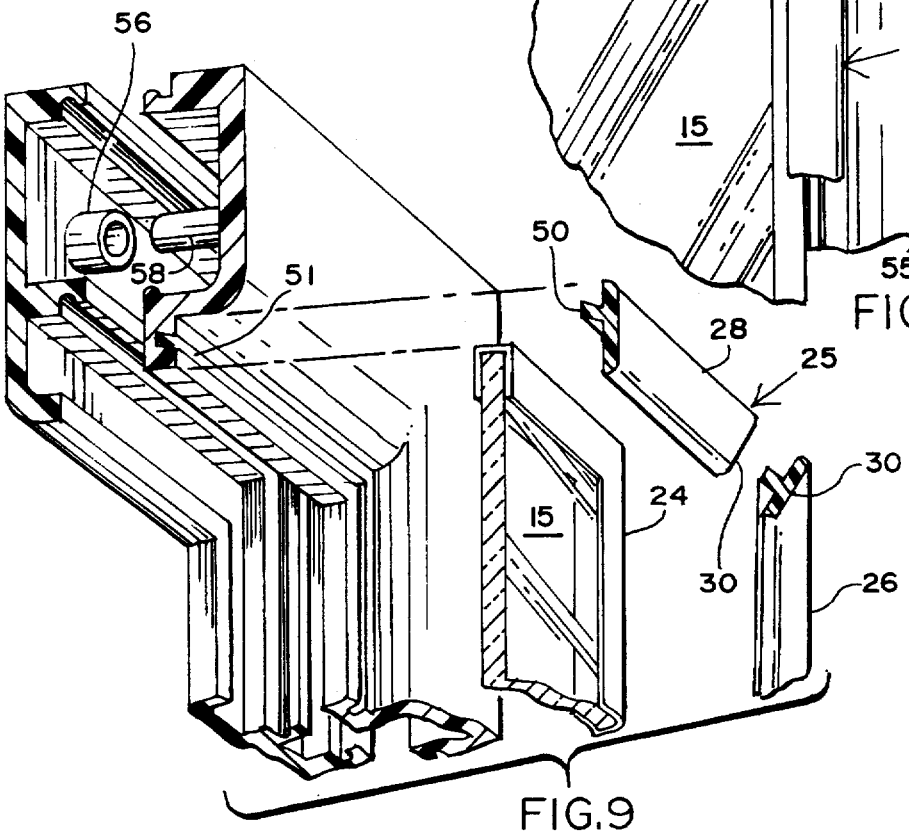
FIG. 9 is an alternative embodiment of the structure shown in FIG. 8 in which a cup and plug are utilized to secure the outer half to the inner half.

In accordance with an alternative embodiment, as shown in FIG. 9, a press-fit lock 55 assembly includes a cup 56 and a plug 58 with a zero tolerance from the outside diameter of the plug 58 to the interior hollow portion of the cup 56. Optionally slots 59 may be molded in the cup 56 to the end that a slight interference fit may exist between the plug 58 and the cup 56 in which the plug 58 is slightly larger than the cup 56 and the slot 59 permits the expansion of the lateral edges of the cup 56 to further securely engage the plug 58.

Figure 10:
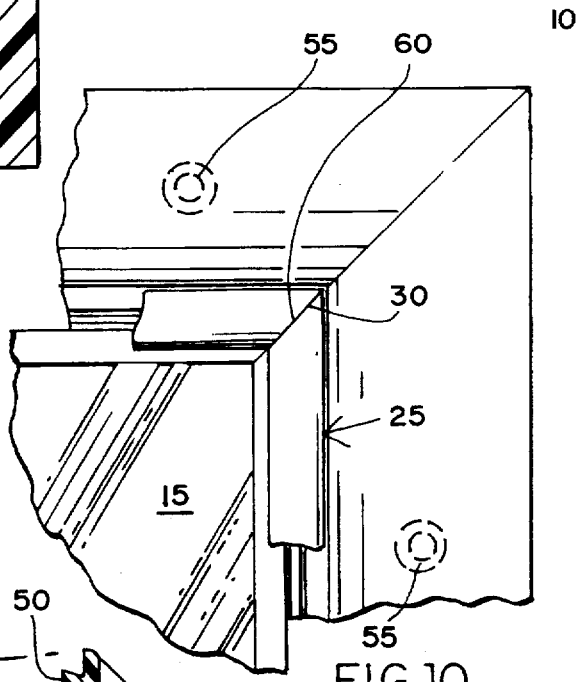
FIG. 10 is an enlarged view of an upper corner of the door showing its principal elements, and particularly showing in phantom lines how the cup and plug alternatives are spaced for securing the two door halves together in accordance with the method of forming a door.

As noted in the enlarged corner view of FIG. 10, the exterior appearance of the corner of the door 10 eliminates the unsightly miter joining the sides, and the top, and the bottom. The trim 24 has a mitered end assembly 60 which permits the entire trim 24 to mask the joint between the window and the door, and yet sturdily but removably secure the window portion in place. The press-fit assembly 55 is shown in phantom lines in FIG. 10. That assembly not only secures the two halves together, but adds rigidity to the entire door 10 and more particularly its frame to reduce torsion which can happen with a door, particularly where a door closer may be employed at the upper portion.

The method of manufacture contemplates forming the frame for a door which may include a one-piece door or an outer frame 20 and an inner frame 21, more particularly which are provided with means for snap-fittingly or otherwise being secured to each other. As shown in FIG. 8, a snap fit is employed. As illustrated in FIGS. 9 and 10, a plug and cup assembly may also be employed. The steps of manufacture contemplate forming the outer frame and the inner frame and thereafter securing the same directly together. At the factory, or optionally at the point of the installation of the door 10, the window 15 may be secured in place by positioning the window trim 24 on the interior portion of the exterior frame 20 with the curvilinear member 40 engaging the window 15. Thereafter, the trim 25 is snapped in place on both lateral edges and top and bottom of the window and the installation is completed.

Depending upon the desire of the occupant of the dwelling, the window 15 can be interchanged for a screen (not shown but having the same exterior dimensions as the window 15) and serve as a full view screen door.

Alternatives to the assembly include a one-piece door, or an assembly with a snap fit, sonic weld, a mechanical attachment, and compression fits. What is important is that the two halves be securely and irremovably fastened to each other when the two half method is used. Once that is accomplished, the trim serves the function of securing the window or the optional screen in place.

As to materials, polypropylene is considered the most desirable. It may have calcium, calcium carbonate, talc, or other additives for stiffness and fire-resistant properties. Materials other than polypropylene such as polystyrene and other sturdy plastics may be employed, but polypropylene is the preferred material. In addition, coloring may be added at the factory, and particularly where the door is to be white the addition of certain additives will give a pleasant white exterior configuration which, in turn, if scratched, will not reveal an under body of a different color and can be buffed out as a minor blemish repair.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A full view door comprising, in combination, a frame comprising a unitary one piece outer molded frame and a unitary one piece inner molded frame, the outer molded frame and the inner molded frame having uninterrupted lateral edges defining top, side, and bottom, said frame having an inner window opening which has sides, top, and a bottom in spaced relationship to the outer and inner molded frames lateral edges, top, and bottom, a window secured the inner window opening, a window support extending from the outer frame top, bottom, and sides to support the window, a single strip for secured over the window lateral edges on the inner side of the inner frame, and means on the inner frame, to removably secure the strip over the window inner top, bottom and sides, whereby a unitary molded frame of a door with pre-formed corners removably and framelessly secures a full view glass window in its window opening portion.

2. The full view door of claim 1, in which, the joint between the outer frame and the inner frame comprises a press-fit assembly of the type including a cup and plug, said cups and plugs being located in opposed relationship to each other for press-fitting inter-engagement in the interior portion of each of the outer frame and the inner frame.

3. The full view door of claim 1, in which, the joint between the outer frame and the inner frame comprises a snap-fitting interlock at at least two opposed portions where the outer frame and inner frame meet each other.

4. In the full view glass door of claim 1, said outer frame having an inner curvilinear portion of a partial U in cross-section in which its end is formed to be substantially flush and perpendicular with the window.

5. In the full view glass door of claim 1, said inner frame at its inside window portion having means for engaging an extension from the outer frame adjacent the inserted window portion.

6. The method of forming a full view glass door which is made up of plastic molded members comprising the steps of:

forming an interior one piece unitary frame and an exterior one piece unitary frame each having means for securing the one to the other, providing a window securing opening having a top, side and bottom in the frame, having means at the top, side and bottom of the window opening for removably securing a glass member, and assembling said frame and glass in a removably secured fashion for installation as a full view door by means of a single removably secured strip overlapping the window from the inside against an abutment engaging the window on the outside.

7. In the method of claim 6, forming a groove in the frame surrounding the window opening, and applying a holding strip to overlie the window which holding strip has an extension to engage the groove.

8. A full view rectangular door comprising, in combination, a rectangular frame comprising an outer one piece rectangular molded frame and an inner one piece rectangular molded frame, the outer molded frame and the inner molded frame having lateral edges defining an uninterrupted top, side, and bottom portion for each frame, said frames having a window opening, which opening has a top, side and bottom edges formed uniformly around the window opening and integrally in each said frame, in spaced relation to the door top, bottom and sides, means for securing the outer frame to the inner frame, one of said frames having an extended window edge portion for overlapping the edges of a glass window, said other member having a window edge extension for abuttingly projecting toward the lateral edges of said glass, and a single removably securable holding means for securement over the glass to overlie the joint between the glass and the extended portion of the opposite frame, whereby a unitary molded frame of a door with pre-formed corners removably secures a full view glass window in its interior portion.

9. The full view door of claim 8, in which, the joint between the outer frame and the inner frame comprises a press-fit assembly of the type including a cup and plug, said cups and plugs being located in opposed relationship to each other for press-fitting inter-engagement in the interior portion of each of the outer frame and the inner frame.

10. The full view door of claim 8, in which, the joint between the outer frame and the inner frame comprises a snap-fitting interlock at at least two opposed portions where the outer frame and inner frame meet each other.

11. In the full view glass door of claim 8, said outer frame having an inner curvilinear portion of a partial U in cross-section in which its end is formed to be substantially flush and perpendicular with the inserted glass.

12. In the full view glass door of claim 7, said inner frame having a perpendicular member extending toward the outer frame at its inside window portion terminating in a perpendicular member extending toward the window intended for positioning in a substantially flush abutting relationship with the inserted glass window portion.

13. A molded full view door comprising, in combination, a door frame having a top, opposed sides, and a bottom, said frame having a window opening with window opening edges at the top, sides and bottom for receiving a removable window, said window opening on all sides defining an uninterrupted peripheral support for engaging a removable window, single trim engaging means adjacent said peripheral support for engaging a trim, and a single trim member formed and proportioned to overlappingly engage the removable window, in cooperation with the peripheral support, with said trim member positioned on the interior portion of the door, whereby a molded door frame for a full view window permits the insertion of a transparent panel secured in place by a trim member directly and framelessly with the top, sides and bottom of the opening which trim member overlappingly engages a window to secure the same in place.

* * * * *